US008317371B1

(12) United States Patent
Khosrow et al.

(10) Patent No.: US 8,317,371 B1
(45) Date of Patent: Nov. 27, 2012

(54) LED DOCK LIGHT

(75) Inventors: Jamasbi Khosrow, Belden, MS (US); David W. Knoble, Tupelo, MS (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 435 days.

(21) Appl. No.: 12/650,139

(22) Filed: Dec. 30, 2009

Related U.S. Application Data

(60) Provisional application No. 61/142,102, filed on Dec. 31, 2008.

(51) Int. Cl.
*F21V 29/00* (2006.01)
*F21L 4/04* (2006.01)

(52) U.S. Cl. ..... 362/373; 362/294; 362/184; 362/199

(58) Field of Classification Search ..... 362/197–199, 362/202, 205, 184, 285, 287, 294, 240, 244, 362/245, 373, 249.02–249.05, 249.07–249.12
See application file for complete search history.

(56) References Cited

U.S. PATENT DOCUMENTS

| | | | | |
|---|---|---|---|---|
| 7,226,189 | B2 * | 6/2007 | Lee et al. | 362/294 |
| 7,950,821 | B1 * | 5/2011 | Georgitsis et al. | 362/217.12 |
| 2002/0093820 | A1 * | 7/2002 | Pederson | 362/241 |
| 2007/0030672 | A1 * | 2/2007 | Offiler et al. | 362/198 |
| 2008/0192461 | A1 * | 8/2008 | Chien | 362/183 |

* cited by examiner

*Primary Examiner* — Thomas Sember
(74) *Attorney, Agent, or Firm* — Mark L. Beloborodov

(57) ABSTRACT

A LED dock light has a support surface, a plurality of light emitting diodes, a heatsink, and a flexible neck member. The light emitting diodes are coupled to a first side of the support surface and the heatsink is coupled to a second side of the support surface. The heatsink has a plurality of heat fins.

14 Claims, 7 Drawing Sheets

LED DOCK LIGHT

CROSS-REFERENCE TO RELATED DOCUMENTS

This application claims priority to and benefit under 35 U.S.C. §119(e) to U.S. Provisional App. No. 61/142,102, filed on Dec. 31, 2008, entitled LED Docklight, the entire contents of which are hereby incorporated by reference.

TECHNICAL FIELD

This invention pertains generally to a dock light, and more particularly to a LED dock light.

BACKGROUND

Many prior art dock lights use incandescent lamps. However, incandescent lamps or bulbs are less efficient than light emitting diodes (LEDs). Typically, the efficiency is on the border of 50 or more lumens per watt. LEDs are more efficient than incandescent lights and have a longer life than incandescent lights. For example, LEDs may have a life of 50,000 hours before decreasing to 70% light output.

SUMMARY

Generally, in one aspect, an LED dock light includes a support surface having a first side and a second side. A plurality of light emitting diodes are coupled to the first side of the support surface and electrically connected to a power source. A plurality of optical pieces are each positioned over at least one of the light emitting diodes and have a reflector surrounding at least on of the light emitting diodes. The optical pieces are configured to direct light emitted by the light emitting diodes into a substantially narrow distribution pattern. The LED dock light also includes a heatsink coupled to the second side of the support surface and having a main body portion and a plurality of exposed heat fins extending radially about the main body portion. A flexible neck member has a first end coupled to the heatsink and surrounded by at least a portion of the heat fins of the heatsink and a second end that is coupled to a mounting base.

In some embodiments the support surface is a metal clad circuit board.

In some embodiments the heatsink has an interior void extending from the first end of the flexible neck member to the support surface.

In some embodiments a thermal layer is provided between the second side of the support surface and the heatsink.

Generally, in another aspect, an LED dock light includes a support surface having a first side and a second side. A plurality of light emitting diodes are coupled to the first side of the support surface and electrically connected to a power source. A plurality of optical pieces are each positioned over at least one of the light emitting diodes and are configured to direct light emitted by the light emitting diodes into a substantially narrow distribution pattern. The LED dock light also includes a heatsink coupled to the second side of the support surface and having a main body portion and a plurality of contoured heat fins extending from the main body portion. The LED dock light also includes a housing having a heatsink portion and an attachment portion. The heatsink portion substantially surrounds the heatsink and has an interior side in direct contact with the heat fins of the heatsink. A flexible neck member has a first end coupled to the attachment portion of the housing and a second end distal the first end. A mounting base is coupled to the flexible member proximal the second end.

In some embodiments the contoured heat fins of the heatsink mate with similarly contoured formations on the interior side of the heatsink portion of the housing to thereby allow transfer of heat from the support surface through the heat sink and to the housing.

In some embodiments the contoured heat fins extend perpendicularly from the main heatsink body.

In some embodiments the main body portion of the heatsink is in direct contact with a similarly contoured portion of the heatsink portion of the housing.

In some embodiments the attachment portion of the housing surrounds and is in direct contact with the first end of the flexible neck member. In some versions of those embodiments the main body portion of the heatsink is in direct contact with the heatsink portion of the housing.

In some embodiments the housing has a plurality of vents therethrough.

Generally, in another aspect, an LED dock light includes a support surface having a first side and a second side. A plurality of light emitting diodes are coupled to the first side of the support surface and electrically connected to a power source. A plurality of optical pieces are each positioned over at least one of the light emitting diodes and are configured to direct light emitted by the light emitting diodes into a substantially narrow distribution pattern. The LED dock light also includes a heatsink coupled to the second side of the support surface. The heatsink has a main body portion and a plurality of heat fins extending from the main body portion. Each of the heat fins have a first contoured surface on a first end and a second contoured surface on a second end distal the first end. The LED dock light also includes a housing having a heatsink portion and an attachment portion. The heatsink portion surrounds the heatsink and has an interior portion. The interior portion is in direct contact with each of the contoured surfaces of the heat fins of the heatsink to allow transfer of heat from the support surface through the heat sink and to the housing. A flexible neck member has a first end coupled to the attachment portion of the housing and a second end distal the first end. A mounting base is coupled to the flexible member proximal the second end.

In some embodiments the heat fins extend perpendicularly from the main body portion of the heatsink.

In some embodiments the main body portion of the heatsink is in direct contact with the heatsink portion of the housing.

In some embodiments the attachment portion of the housing surrounds and is in direct contact with the first end of the flexible neck member. In some embodiments the main body portion of the heatsink is in direct contact with the heatsink portion of the housing. In some versions of these embodiments the attachment portion of the housing surrounds and is in direct contact with the flexible neck member. In some versions of these embodiments the housing has a plurality of vents therethrough.

BRIEF DESCRIPTION OF THE ILLUSTRATIONS

DETAILED DESCRIPTION

Figure 1:
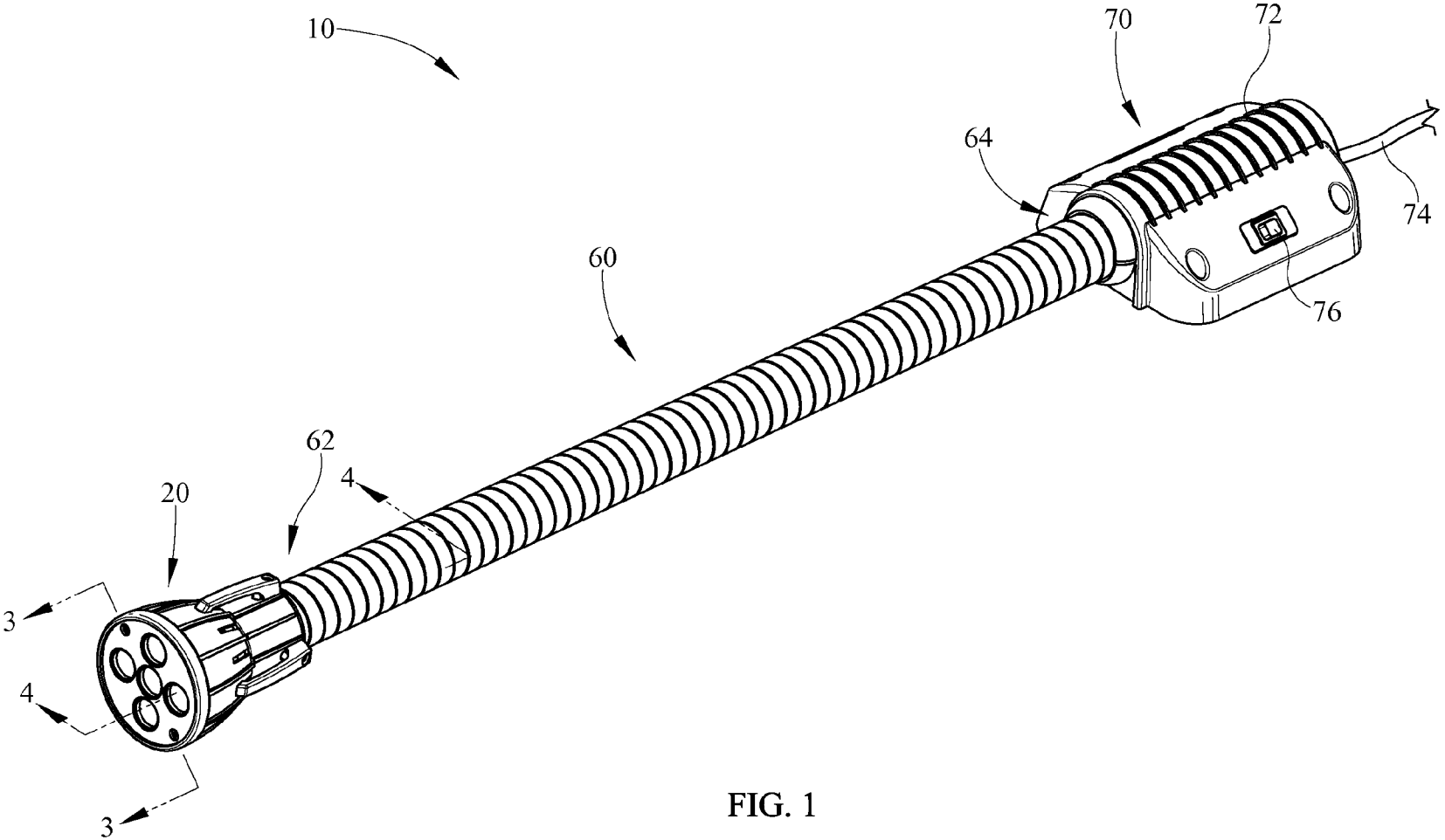
FIG. 1 is a perspective view of a first embodiment of a dock light of the present invention.
Figure 2:
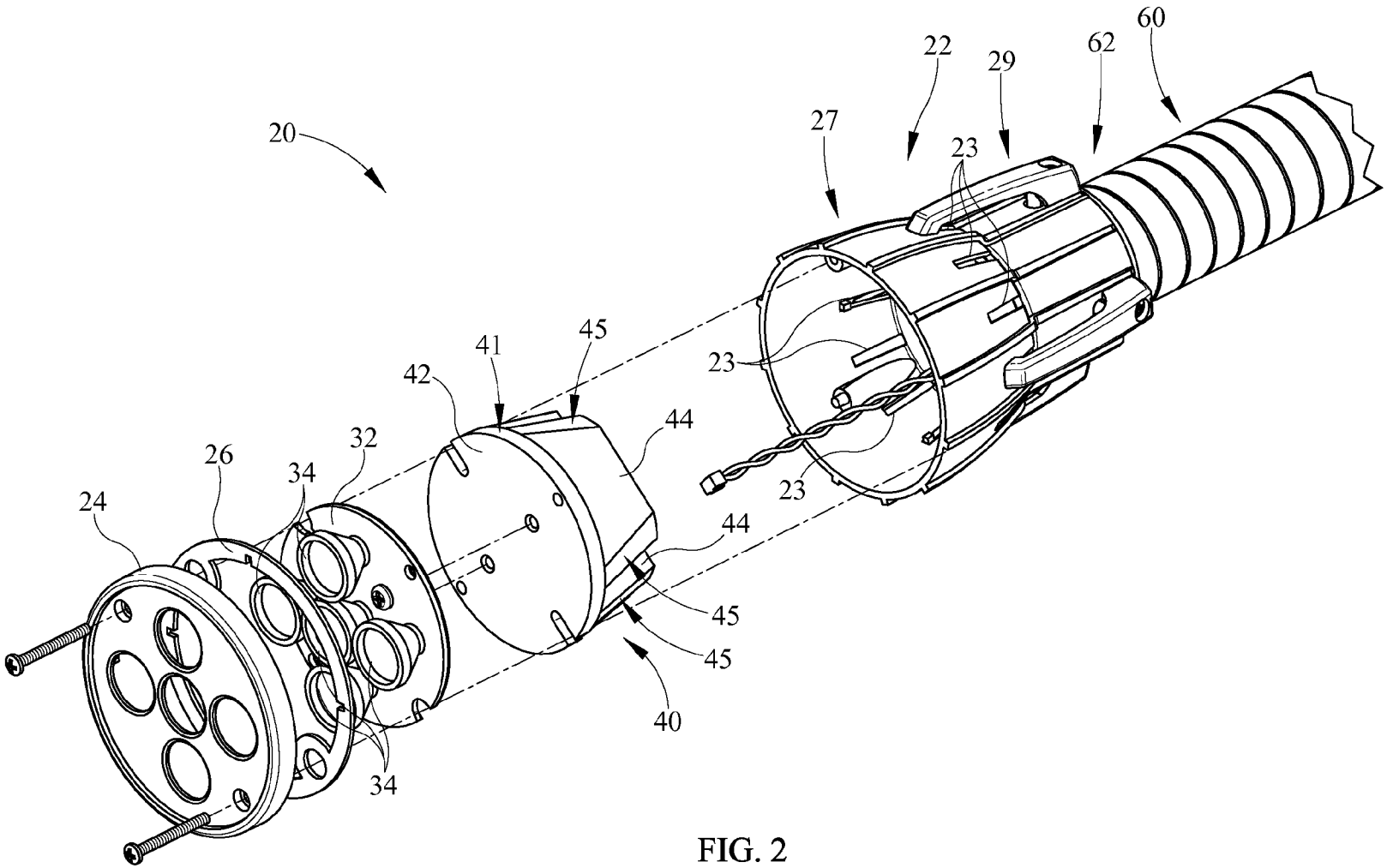
FIG. 2 is an exploded perspective view of a light emitting diode head and a portion of a flexible neck of the first embodiment of the LED dock light of FIG. 1.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and that other alternative mechanical configurations are possible.

With reference to FIG. 1 through FIG. 4, a first embodiment of a flexible LED luminaire 10 is shown. The terms "LED" and "light emitting diode" as used herein are meant to be interpreted broadly and can include, but are not limited to, an LED of any luminosity and any light distribution pattern, and also includes, but is not limited to, an organic light emitting diode (OLED). With reference to FIG. 1, flexible LED luminaire 10 has a head 20 and a mounting base 70 with a flexible neck 60 extending between head 20 and mounting base 70. Mounting base 70 may be removably or fixedly coupled to a mounting surface such as, for example, a wall or an I-beam in a warehouse. In some embodiments a plurality of apertures may be provided in mounting base 70 for receiving mounting hardware such as a stud or a bolt. Mounting base 70 has a ballast housing 72 that encloses a light emitting diode power supply. In some embodiments the light emitting diode power supply is configured to receive a 120 Volt input and provide fifteen Watts of power to LEDs. In other embodiments of luminaire 10 light emitting diode power supplies may be located elsewhere on flexible LED luminaire 10, located remotely from LED luminaire 10, or omitted. An electrical cord 74 extends from mounting base 70 and may be coupled to an external power source to provide electrical power to the light emitting diode power supply enclosed within housing 72. In other embodiments of luminaire 10 electrical cord 74 may be omitted and a power source internal to flexible LED luminaire 10 may be used. A switch 76 is located on ballast housing 72 and may be actuated to selectively power flexible LED luminaire 10. In other embodiments of luminaire 10 switch 76 may be located on head 20, flexible neck 60, located remotely from flexible LED luminaire 10, or omitted. In some embodiments an electrical receptacle that is in electrical connectivity with electrical cord 74 may be added to ballast housing 72 for convenience.

Flexible neck 60 has a first end 62 coupled to head 20 and a second end 64 coupled to ballast housing 72. Flexible neck 60 may be adjusted to and temporarily fixed at a plurality of orientations to enable head 20 to be directed toward a desired illumination area. Flexible neck 60 may be readjusted to and temporarily fixed to another orientation as desired. In some embodiments of luminaire 10 flexible neck 60 may house electrical wiring that extends from mounting base 70 to head 20. In some embodiments of luminaire 10 flexible neck 60 may be constructed from a metal having desirous heat distribution properties such as, but not limited to, stainless steel or aluminum.

With continuing reference to FIGS. 1-4, a housing 22, a bezel 24, and a gasket 26 enclose a support surface 32 having five LED optical pieces 34 placed over five corresponding LEDs 35 that are coupled to support surface 32. Optical pieces 34 include a reflector **34*a* substantially surrounding each LED 35 and having a lens on an opposite end of the reflector 34*a*. A lens, 25, shown in FIG. 3 and FIG. 4, may be placed over bezel 24 if desired to, for example, seal housing 22, prevent contact with optical pieces 34, or to alter optical characteristics of light exiting through lens 25. Housing 22 may be provided with one or more vents 23 therethrough to allow for better airflow and heat dissipation. In some embodiments of LED dock light 10 support surface 32 may be a flame retardant four (FR-4) or other common printed circuit board. In other embodiments support surface 32 is a metallic board with advantageous heat distribution properties such as, but not limited to, aluminum. In some embodiments support surface 32 is a metal clad circuit board with an aluminum core. In other embodiments support surface 32 is a shape other than circular, such as, but not limited to square or rectangular. In some embodiments optical pieces 34 and their corresponding LEDs are configured to produce a narrow beam distribution so that far away areas may be appropriately illuminated. In some embodiments reflectors 34*a* are configured to direct light emitted by LEDs 35 into narrow beams that will sufficiently illuminate a far end of a common semi trailer when the luminaire 10** is located at a near end of the semi trailer that is distal the far end. In some embodiments each LED consumes approximately three watts of power and outputs approximately 180 lumens.

Housing 22 has a heatsink portion 27 that surrounds and is in contact with a heatsink 40. Housing 22 also has an attachment portion 29 that is coupled to and surrounds first end 62 of flexible neck 60. Housing 22 is constructed from a metal having desirable heat distribution properties, such as, but not limited to, aluminum or stainless steel. Heatsink 40 is coupled to and in thermal connectivity with support surface 32. Heatsink 40 is constructed from a metal having desirable heat distribution properties, such as, but not limited to, aluminum. Heatsink 40 has a main body portion 42 and a plurality of heat fins 44 extending away from main body portion 42. Contoured portions 45 are provided on distal ends of each heat fin 44. Contoured portions 45 correspond to the contour of heatsink portion 27 of housing 22. When LED dock light 10 is assembled, contoured portions 45 of heat fins 44 contact heatsink portion 27 of housing 22. In the embodiment of FIGS. 1-4 an outer periphery 41 of main body portion 42 is also contoured to correspond to the contour of heatsink portion 27 and contacts heatsink portion 27 of housing 22 when dock light 10 is assembled.

Heatsink 40 dissipates heat generated by the LEDs provided on support surface 32. Some of the heat is dissipated by main body 42 and some is transferred from main body 42 to heat fins 44 and dissipated by heat fins 44. Some of the heat is transferred from heatsink 40 to housing 22 through direct contact between contoured portions 45 and heatsink portion 27 of housing 22 and some of the heat is transferred from heatsink 40 to housing 22 through direct contact between outer periphery 41 of main body portion 42 and heatsink portion 27 of housing 22. Some heat is also transferred from heatsink 40 to housing 22 through indirect thermal transfer.

Figure 3:
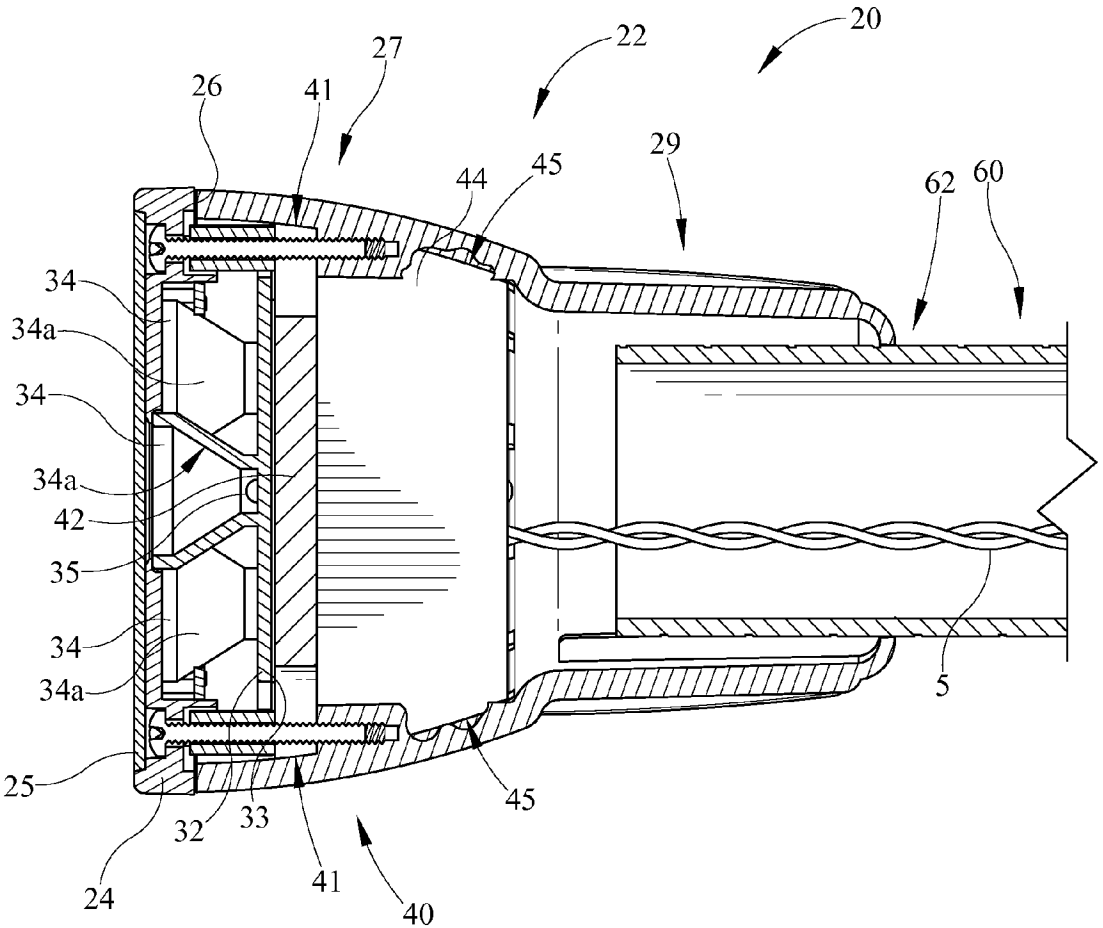
FIG. 3 is a side view, in section, of the light emitting diode head and a portion of the flexible neck of the first embodiment of the LED dock light of FIG. 1 taken along the section line 3-3 of FIG. 1.
Figure 4:
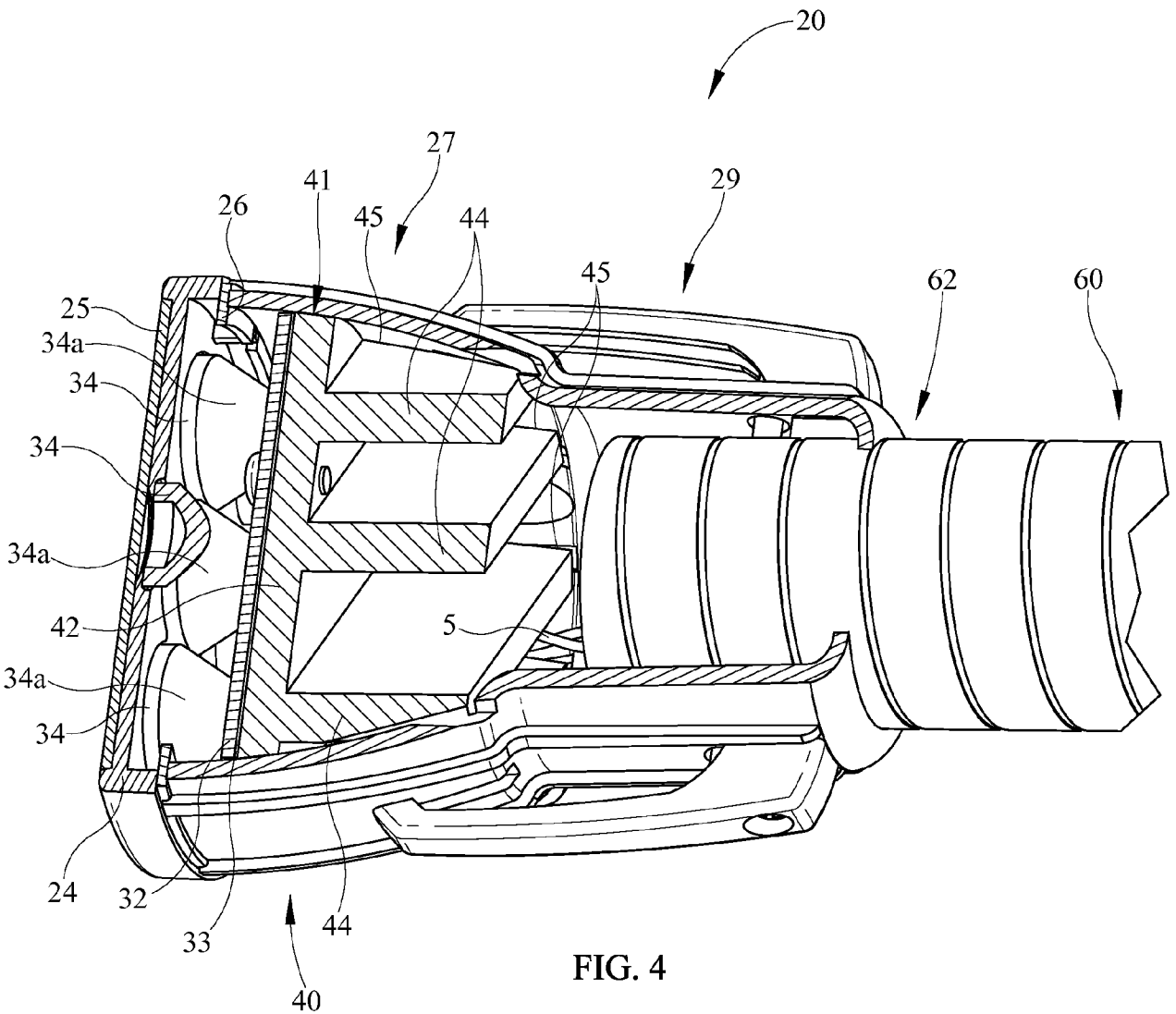
FIG. 4 is a perspective view, in section, of the light emitting diode head and a portion of the flexible neck of the first embodiment of the LED dock light of FIG. 1 taken along the section line 4-4 of FIG. 1, with a portion of a heatsink portion of a housing broken away.

With particular reference to FIG. 3 and FIG. 4, first end 62 of flexible neck 60 is coupled to and surrounded by attachment portion 29 of housing 22. Attachment portion 29 of housing 22 may contact or be sufficiently close to second end 62 of flexible neck 60 so as to allow heat to be transferred from housing 22 to flexible neck 60 to aid in dissipation of heat. Heatsink 40, housing 22, and flexible neck 60 provide heat dissipation for LEDs mounted on support surface 32. A thermal layer 33 may be provided between support surface 32 and heatsink 40 to aid in heat dissipation. In some embodiments thermal layer 33 may be a thermal pad and in other embodiments thermal layer 33 may be a thermal compound, such as, but not limited to a thermal silicon paste. Thermal layer 33 may be omitted in other embodiments if not desired for heat dissipation.

Figure 5:
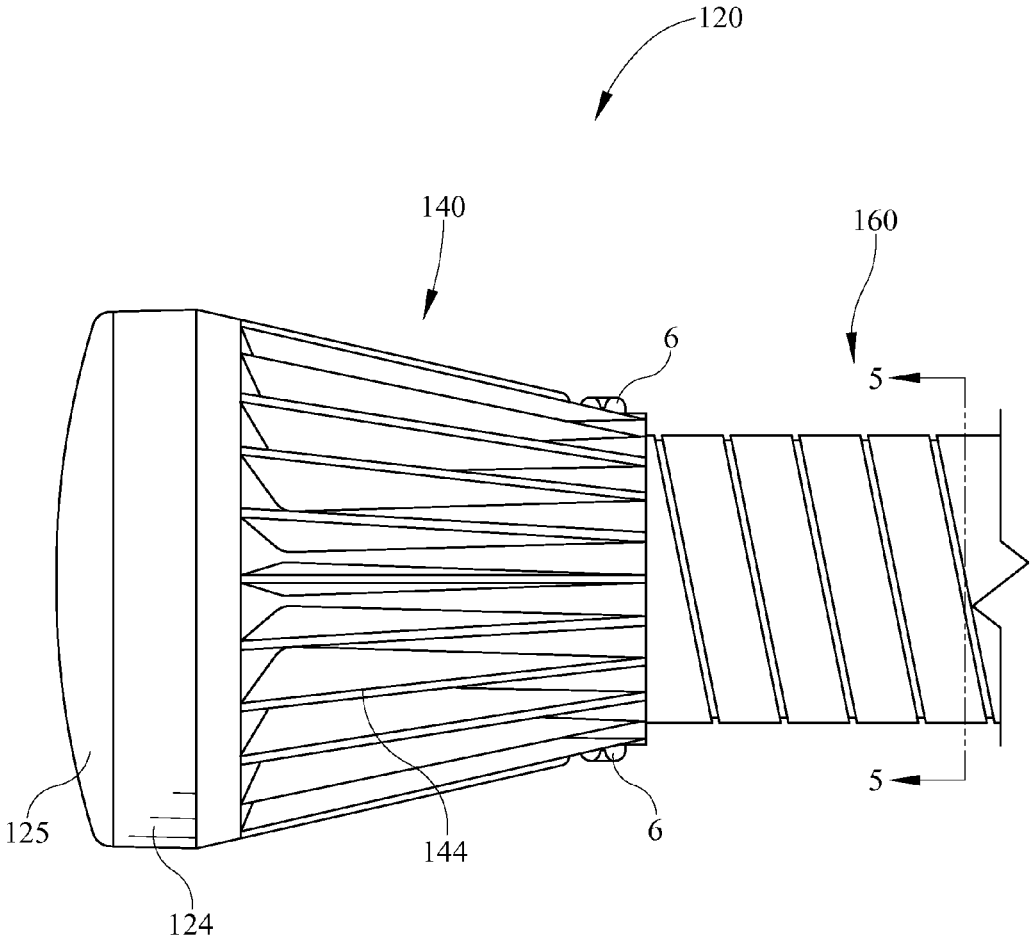
FIG. 5 is a side view of a light emitting diode head and a portion of a flexible neck of a second embodiment of a flexible light emitting diode luminaire.
Figure 6:
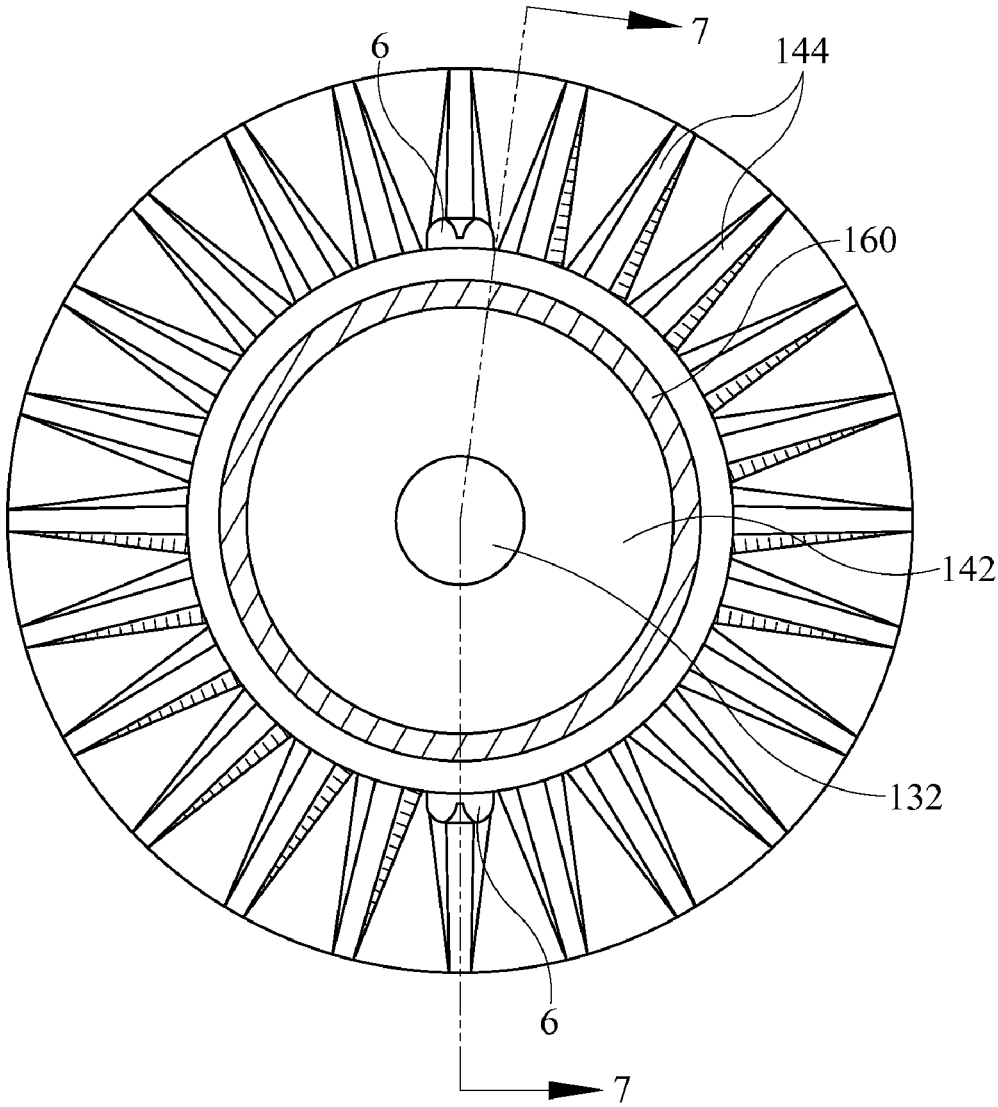
FIG. 6 is a rear view, in section, of the light emitting diode head and the portion of a flexible neck of the second embodiment of a flexible light emitting diode luminaire of FIG. 5 taken along the line 5-5 of FIG. 5.
Figure 7:
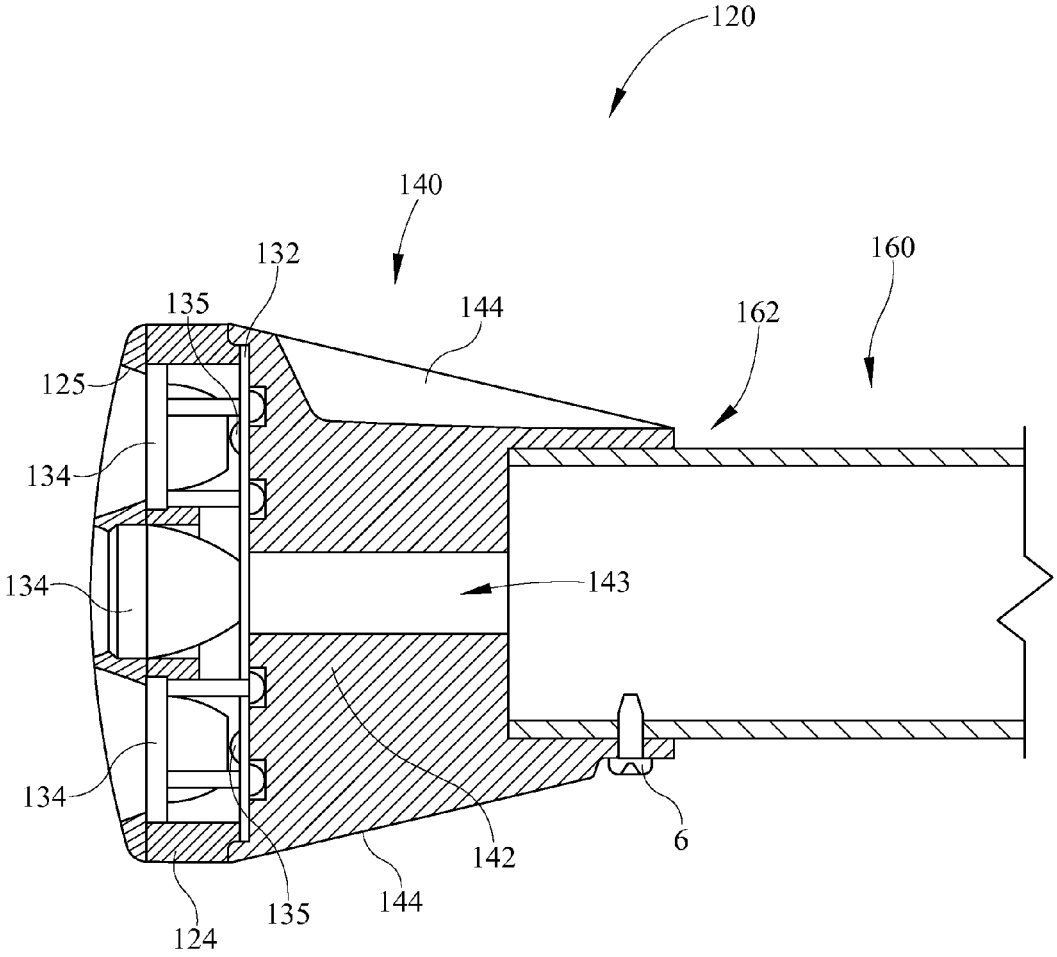
FIG. 7 is a side view, in section, of the light emitting diode head and a portion of the flexible neck of the second embodiment of the LED dock light of FIG. 5 taken along the line 7-7 of FIG. 6.

With reference to FIG. 5 through FIG. 7, a second embodiment of a head 120 is shown. Head 120 has a heatsink 140 coupled to and in thermal connectivity with a support surface 132 having a plurality of LEDs 135. Optical pieces 134 are provided over corresponding LEDs 135. Heatsink 140 has an interior void 143 and a main body portion 142 and a plurality of heat fins 144 extending radially about interior void 143 and main body portion 142. In some embodiments heatsink 140 is constructed from a metal having advantageous heat distribution properties, such as, but not limited to, aluminum. In some embodiments electrical wiring may extend through interior void 143 to provide power to LEDs 135. Heat fins 144 are exposed and form part of the housing for head 120. Heat sink 140 surrounds a portion of first end 162 of flexible neck 160 and is coupled to first end 162 of flexible neck 160 by screws 6. In the embodiment of FIGS. 5-7 first end 162 contacts heatsink 140 allowing heat to be better transferred from second heatsink 140 to flexible neck 160 to aid in dissipation of heat. Flexible neck 160 may be constructed from a metal having desirable heat distribution properties, such as, but not limited to, aluminum or stainless steel.

A cover 124 and a lens 125 couple to heatsink 140 to enclose support surface 132 and corresponding LEDs 135 that are coupled to support surface 132. Lens 125 may be placed over cover 124 if desired for sealing support surface 132, optical pieces 134, and/or LEDs 135 or to alter optical characteristics of light exiting through lens 124. Heatsink 140 dissipates heat generated by the LEDs provided on support surface 132. Some of the heat is dissipated by main body 142 and some is dissipated by heat fins 144. Some of the heat is transferred from heatsink 140 to flexible neck 160 through direct contact between heatsink 140 and first end 162 of flexible neck 160. Some of the heat is transferred from heatsink main body portion 142 and fins 144 of heatsink 140 to the external environment.

The foregoing description has been presented for purposes of illustration. It is not intended to be exhaustive or to limit the invention to the precise forms disclosed, and obviously many modifications and variations are possible in light of the above teaching. It is understood that while certain forms of the LED dock light have been illustrated and described, it is not limited thereto except insofar as such limitations are included in the following claims and allowable functional equivalents thereof.

We claim:

1. A LED dock light comprising:

a support surface having a first side and a second side;

a plurality of light emitting diodes coupled to said first side of said support surface and electrically connected to a power source;

a plurality of optical pieces, each said optical piece positioned over a light emitting diode, wherein said optical pieces are configured to direct light emitted by said light emitting diodes into a substantially narrow distribution pattern;

a heatsink coupled to said second side of said support surface, said heatsink having a main body portion and a plurality of contoured heat fins extending from said main body portion;

a housing having a heatsink portion and an attachment portion, said heatsink portion substantially surrounding said heatsink and having an interior side in direct contact with said heat fins of said heatsink;

a flexible neck member having a first end and a second end, said first end coupled to said attachment portion of said housing; and a mounting base coupled to said flexible neck member proximal said second end;

wherein said contoured heat fins of said heatsink mate with similarly contoured formations on said interior side of said heatsink portion of said housing to allow transfer of heat from said support surface through said heat sink and to said housing.

2. The LED dock light of claim 1, wherein said contoured heat fins extend perpendicularly from said main heatsink body.

3. The LED dock light of claim 2, wherein said main body portion of said heatsink is in direct contact with said heatsink portion of said housing.

4. The LED dock light of claim 3, wherein said contoured heat fins extend perpendicularly from said main heatsink body.

5. The LED dock light of claim 2, wherein said housing has a plurality of vents therethrough.

6. The LED dock light of claim 1, wherein said main body portion of said heatsink is in direct contact with a similarly contoured portion of said heatsink portion of said housing.

7. The LED dock light of claim 1, wherein said attachment portion of said housing surrounds and is in direct contact with said first end of said flexible neck member.

8. A LED dock light comprising:

a support surface having a first side and a second side;

a plurality of light emitting diodes coupled to said first side of said support surface and electrically connected to a power source;

a plurality of optical pieces, each said optical piece positioned over a light emitting diode, wherein said optical pieces are configured to direct light emitted by said light emitting diode into a substantially narrow distribution pattern;

a heatsink coupled to said second side of said support surface, said heatsink having a main body portion and a plurality of heat fins extending from said main body portion, each of said heat fins having a first contoured surface on a first end thereof and a second contoured surface on a second end thereof distal said first end;

a housing having a heatsink portion and an attachment portion, said heatsink portion surrounding said heatsink and having an interior portion, said interior portion in direct contact with each said contoured surface of said heat fins of said heatsink to allow transfer of heat from said support surface through said heat sink and to said housing;

a flexible neck member having a first end and a second end, said first end coupled to said attachment portion of said housing; and a mounting base coupled to said flexible neck member proximal said second end.

9. The LED dock light of claim 8, wherein said heat fins extend perpendicularly from said main body portion of said heatsink.

10. The LED dock light of claim 8, wherein said main body portion of said heatsink is in direct contact with said heatsink portion of said housing.

11. The LED dock light of claim 8, wherein said attachment portion of said housing surrounds and is in direct contact with said first end of said flexible neck member.

12. The LED dock light of claim 8, wherein said main body portion of said heatsink is in direct contact with said heatsink portion of said housing.

13. The LED dock light of claim 12, wherein said attachment portion of said housing surrounds and is in direct contact with said flexible neck member.

14. The LED dock light of claim 13, wherein said housing has a plurality of vents therethrough.

* * * * *